United States Patent [19]

Irani et al.

[11] Patent Number: 4,707,883

[45] Date of Patent: Nov. 24, 1987

[54] BAG HANDLE

[75] Inventors: Andrew A. Irani; Bernd H. Schulte-Ladbeck; Aspee A. Arani, all of Houston, Tex.

[73] Assignee: Polsun Manufacturing Corporation, Houston, Tex.

[21] Appl. No.: 943,810

[22] Filed: Dec. 19, 1986

Related U.S. Application Data

[63] Continuation-in-part of Ser. No. 798,949, Nov. 18, 1985, and a continuation-in-part of Ser. No. 820,997, Jan. 22, 1986.

[51] Int. Cl.[4] ..... B65D 33/06

[52] U.S. Cl. ..... 16/110 R; 383/16

[58] Field of Search ..... 383/12, 15, 16, 63; 16/110

[56] References Cited

U.S. PATENT DOCUMENTS

| | | | |
|---|---|---|---|
| 3,335,941 | 8/1967 | Gatward | 383/15 |
| 3,462,068 | 8/1969 | Suominen | 383/15 |
| 3,463,381 | 8/1969 | Wainberg | 383/15 |
| 3,486,683 | 12/1969 | Kamins et al. | 383/15 |
| 4,316,629 | 2/1982 | Jacoby | 383/15 |
| 4,387,846 | 6/1983 | DuCorday | 229/54 R |

FOREIGN PATENT DOCUMENTS

| | | | |
|---|---|---|---|
| 1008068 | 10/1965 | United Kingdom | 383/15 |

*Primary Examiner*—E. R. Kazenske
*Assistant Examiner*—James L. Wolfe
*Attorney, Agent, or Firm*—Finnegan, Henderson, Farabow, Garrett & Dunner

[57] ABSTRACT

A bag handle having opposing handle strips with an interlocking tab and slot which prevents separation of the handle strips.

20 Claims, 13 Drawing Figures

BAG HANDLE

The present application is a continuation-in-part, of U.S. application Ser. No. 798,949, filed Nov. 18, 1985 and of U.S. application Ser. No. 820,997 filed Jan. 22, 1986. The present invention relates to carrying handles and more particularly to handles for sealing and carrying thermoplastic bags.

BACKGROUND OF THE INVENTION

Handles for bags designed for carrying products or articles are well known. Certain paper bags are provided with cardboard reinforcing handles secured to the paper bag by gluing or stapling. Larger paper bags are often provided with loop type carrying handles secured to reinforced areas of the paper bag by gluing or stapling.

Plastic bags, however, such as polyethylene or other thermoplastic bags, are usually too thin or are otherwise unsuitable for the attachment of handles by gluing or stapling. Such thermoplastic bags are typically provided with handles of several layers of the bag material heat welded to form a reinforced handle section thicker than the bag material. Such handles are typically manufactured of a compatible thermoplastic material and attached to the bag opening by heat welding. Such handles often provide for sealing of the bag opening through frictional engagement of pins or posts on one section of the handle assembly with holes or recesses in the complementary section of the handle assembly.

The seal provided by such posts and hole closure of the handle is of limited strength. The frictional engagement of the post with the hole is the only retaining force provided. When bags employing such a handle closure are used to carry heavy or bulky objects such closures tend to separate. Increasing the frictional engagement between the pin and hole can be helpful, but the use of an excessive frictional engagement results in a bag handle which is very difficult to open or close.

Often it is desirable to keep relatively heavy objects sealed within a carrier bag. For example, insulated bags that carry hot or cold products, such as food and drink, need to be sufficiently strong so as not to tear or open while maintaining the appropriate seal on the bag to achieve the insulation effect. Handles for such a carrier bag must be sufficiently strong to support the weight contained in the bag. The handle must also be capable of remaining in a closed position so that the carrier bag is sealed while being carried and does not tear open.

Various problems arise in both keeping the carrier bag airtight and providing the requisite strength in the carrier bag handle. It is especially difficult to keep the carrier bag airtight during the lifting of the bag because the free weight of the contents of the bag puts a downward pressure on the bag handle and the size of the contents of the bag creates outward horizontal forces on the handle, the bigger the size the larger the horizontal forces. As a result, the bag handle opens to expose the bag contents. If the carrier bag is being used as an insulation bag, the insulation effect is consequently broken.

Thus, there is a significant, unmet need for a carrier bag handle that both effectively seals the carrier bag in a closed position and is sufficiently strong to support a relatively heavy weight in the carrier bag. Moreover, it is especially desirable that the carrier bag handle be easy to use so that the carrier bag can be readily opened and closed as desired.

SUMMARY OF THE INVENTION

In accordance with the present invention there is provided a bag handle comprising opposing handle strips having a line of attachment for a bag and releasable interlocking means on the handle strip below the line of attachment for the bag for holding the handle strips together.

There is further provided a bag handle closure device comprising a pair of opposing handle strips adapted to be attached to a bag or the like, at least one of said handle strips having a handle loop, releasable connecting means on said handle strips above the lower edge portions of said strips to connect said handle strips releasably together in substantially parallel relationship, characterized in that interlocking means are provided on the lower portion of each of said handle strips for retaining said handle strips together at said lower portion thereby to hold the strips against opening apart when they are adjacent to each other with the interlocking means engaged.

A carrier bag handle closure embodying the invention can effectively maintain a carrier bag in a closed condition even when relatively heavy or bulky items are carried in the carrier bag. Furthermore, the bag closure can be easy to open and close when required and be economic to manufacture.

In one preferred embodiment of the invention the releasable connecting means comprises an outer closure member on one handle strip and an inner closure member on the other handle strip, the inner and outer closure members coacting in a complementary snap-on engagement when the handle strips are connected together.

The use of both the outer and inner closure members and the interlocking means on the carrier bag handle provides a tight, double lock seal to keep the bag handle in a closed position even if a relatively heavy weight, such as 50 lbs., is within the carrier bag. Even when the outer closure member and the inner closure member are not in a snap-on engagement, the interlocking means still prevents the closure bag from opening. The carrier bag opens only when the double lock is open, namely both the snap-on engagement of the inner and outer closure members and the interlocking means.

BRIEF DESCRIPTION OF THE DRAWINGS

A full understanding of the invention will be had from the following detailed description of some embodiments, reference being made to the accompanying drawings, in which.

DETAILED DESCRIPTION OF THE INVENTION

The bag handle closures of the present invention are described as fixed to thermoplastic bags, but they could easily be adapted to other types of bags.

Figure 1:
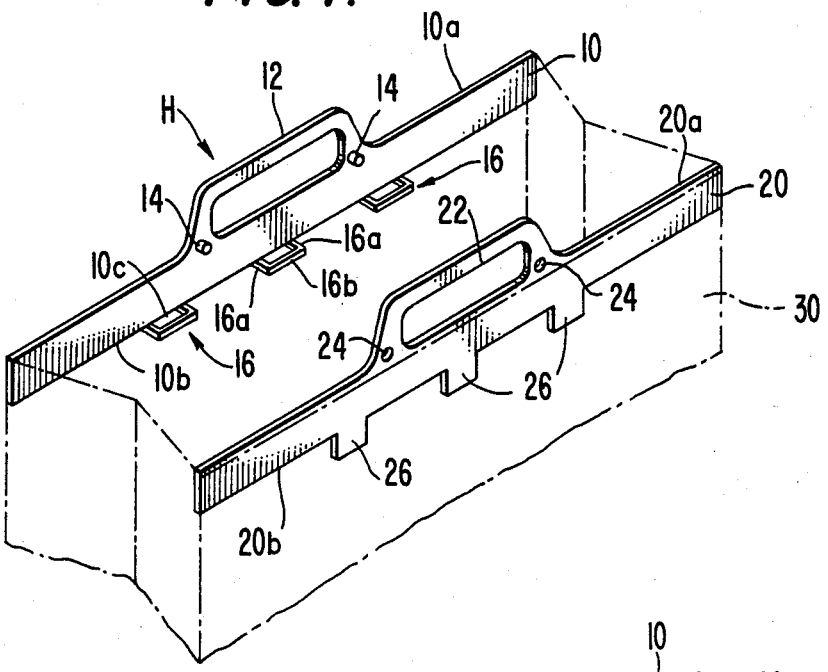
FIG. 1 is a perspective view showing a bag handle closure of the present invention in an open position.
Figure 2:
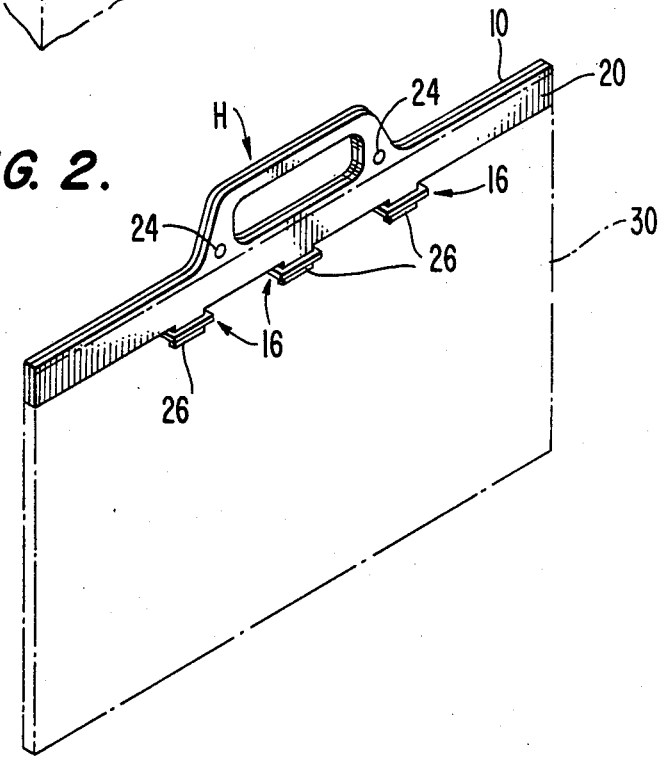
FIG. 2 is a perspective view showing a bag handle closure in a closed position.

The bag closure of FIGS. 1 and 2 comprises a pair of opposing or complementary handle portions or strips 10 and 20. The handle portions 10 and 20 are preferably of a thermoplastic material suitable for attachment to the bag 30, shown in phantom, by heat welding. Each handle portion 10, 20 preferably has formed along its top edge 10*a* and 20*a*, respectively, a handle loop 12 and 22. However, only one of the handle portions 10, 20 may have a handle loop in some cases.

Extending from handle portion or strip 10 are pins 14, preferably adjacent the handle loop 12. On handle portion 20 adjacent the handle 22 corresponding to pins 14 of strip 10 are holes 24. Each hole 24 is slightly smaller in diameter or size than each pin 14 so that when strip 10 is oriented adjacent to strip 20, pins 14 frictionally engage holes 24 to releasably maintain the strips 10 and 20 in a bag closed position (FIG. 2). Other suitable gripping means, preferably of snapengagement type either on the handle strips 10, 20 or the handle loops 12, 22 may be used.

Extending from the bottom edge 10*b* of strip 10 are one or more notch-forming elements 16. The notch-forming elements 16 preferably are formed from end sections 16*a* extending substantially perpendicular to strip 10 and a crossbar 16*b* interconnecting the end sections 16*a* so as to form an opening or slot 10*c* adjacent strip 10. On strip 20, corresponding to each element 16 on strip 10, is a tab 26. Each tab 26 extends from the bottom edge 20*b* of handle portion 22 (FIG. 1). Tabs 26 correspond in number and orientation with respect to the position and number of the notch-forming members 16 such that tabs 26 can slide into the openings or slots 10*c* prior to engagement of holes 24 by pins 14.

In practice, the handle closure is preferably used in combination with a bag made of relatively thin polyethylene material. Handle strips 10 and 20 are also preferably polyethylene and are heat welded to the bag.

To close the bag, tabs 26 of strip 20 are aligned above the elements 16 of strip 10 and then are slid downwardly into the slots 10*c*. The upper part of the handle portions 10 and 20 are at least slightly separated from each other at the time the tabs 26 are being seated in the slots 10*c*, so that the pins 14 do not enter the holes 24. After the tabs 26 are fully seated in the slots 10*c* as shown in FIG. 2, the pins 14 are still not in the holes 24 until the pins 14 are frictionally forced into holes 24 by the user squeezing the handle portions 10, 20 towards each other, thereby sealing the bag opening (FIG. 2) and providing a convenient carrying handle H. The positioning of tabs 26 in slots 10*c* provides a closure resistant to inadvertent release of pins 14 from holes 24 which might otherwise ca.use separation of the bag material due to heavy or bulky items in the bag.

When it is desired to re-open the bag, the user simply pulls the handle portions 10 and 20 apart, usually by pulling on the handle loops 12, 22, which initially releases the pins 14 from the holes 24. Thereafter, by removing the handle portions 10, 20 laterally away from each other with a slight lifting movement, the tabs 26 are easily lifted out of the slots 10*c* and the bag is fully opened (FIG. 1).

It should be understood that although only two pins 14 and two holes 24 are illustrated in the drawings, it is preferable to have more of each, generally at positions along the length of the handle portions 10, 20. Also, the notch-forming member 16 or the tab 26 may be formed in other shapes and configurations so long as it is adapted to receive and interlock the handle strip below the line of attachment of the bag to the handle strip.

In the embodiment shown in FIGS. 3 to 9, the carrier bag handle 110 has a pair of opposing handle strips 112 and 114 capable of being attached to a carrier bag 111. At least one of the handle strips 112 and 114 has a handle loop 116.

Preferably, the handle strips 112 and 114 are made of thermoplastic or thermoset material that provides the requisite strength to the bag handle. Typically, the thermoplastic or thermoset material, such as polyethylene, can be attached to the carrier bag by heat seal or sonic weld techniques. Of course, other materials for the handle strips 112 and 114 and other methods of attaching these strips to the carrier bag can be used within the scope of the invention. Preferably, both hand:le strips 112 and 114 have a handle loop 116 that is of the size and shape to accommodate the hand of a person carrying the carrier bag. In some situations, only one of the handle strips 112 and 114 may need to have a handle loop 116.

The handle strips 112 and 114 can be of various sizes and shapes depending upon the type of carrier bag 111 to which the handle 110 is attached and the anticipated contents of the carrier bag. For example, in one embodiment, each handle strip 112 and 114 can be about 16 inches (35 cms) in length, one inch (2.5 cm) in height, and about a tenth of an inch (2.5 mm) in width.

In accordance with the present invention, one of the opposing handle strips has an outer closure member and the other opposing handle strip has an inner closure member. The outer closure member and the inner closure member coact in a complementary snap-on engagement when the carrier bag is in a closed position. One of the opposing handle strips 114 has an outer closure member 118 and the other opposing handle strip 112 has an inner closure member 120. The outer closure member 118 and the inner closure member 120 coact in a complementary snap-on engagement when the carrier bag is in a closed position, as illustrated in FIG. 3.

The outer closure member 118 and the inner closure member 120 are located on the upper portions 122 of the handle strips 112 and 114. The outer closure member 118 comprises a curved wall 124 that defines a groove 126 between the curved wall 124 and the upper portion 122 of the handle strip 114 having the outer closure member 118. The inner closure member 120 may be an arcuate surface of a size and shape to fit within the groove 126 when the carrier bag handle 110 is in a closed position.

Figure 3:
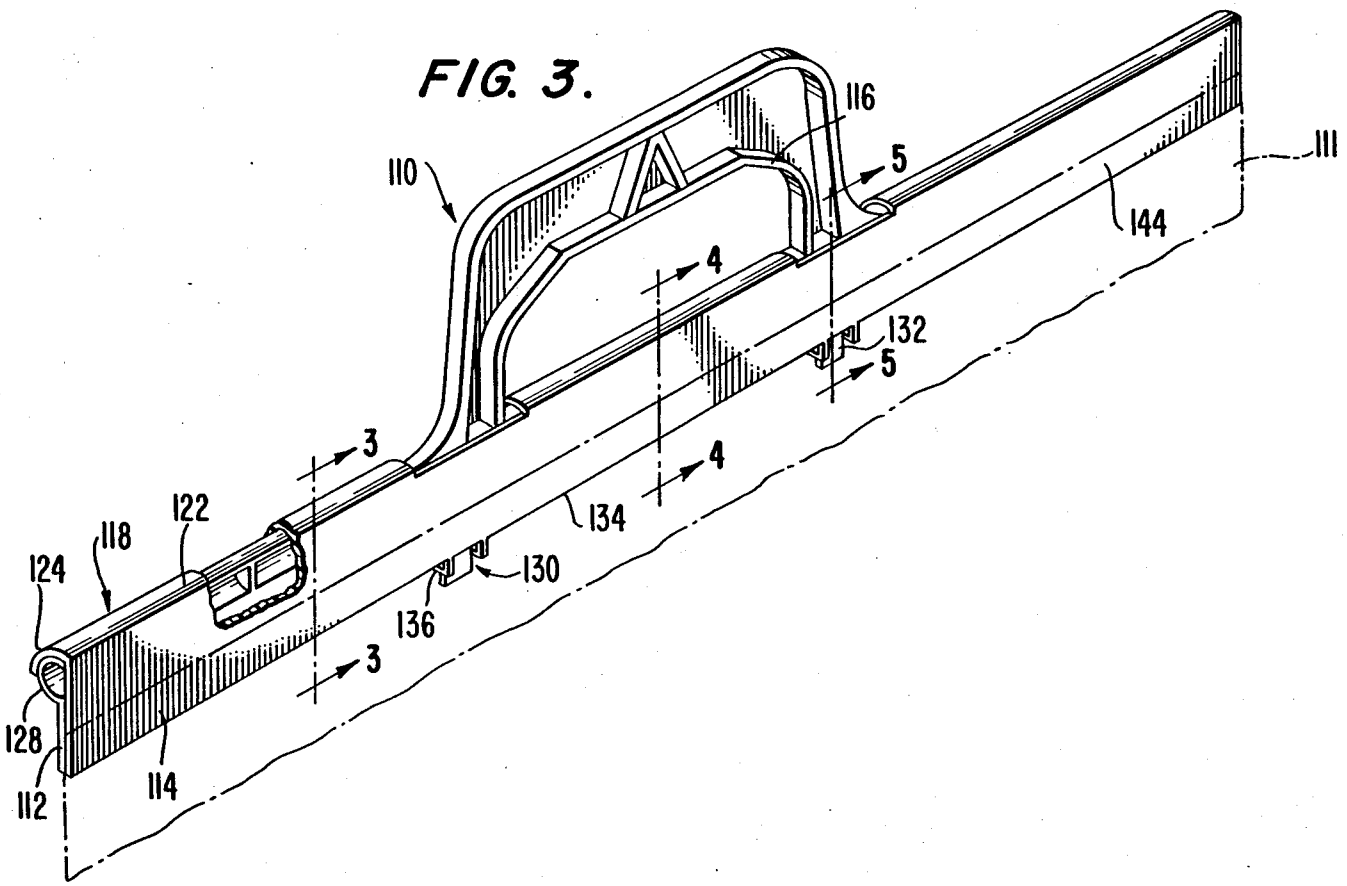
FIG. 3 is a perspective view of another carrier bag handle closure of the present invention in a closed position.
Figure 4:
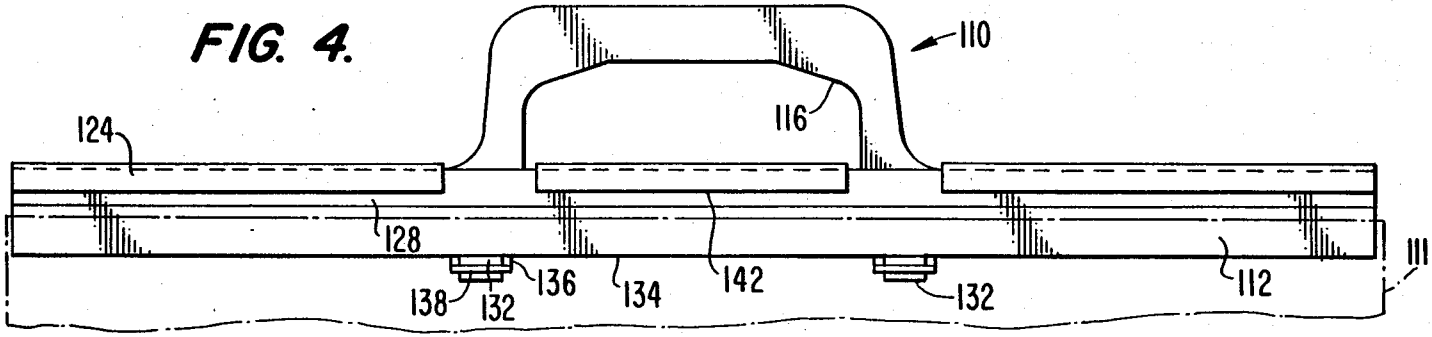
FIG. 4 is a side view of the carrier bag handle closure of FIG. 3.
Figure 7:
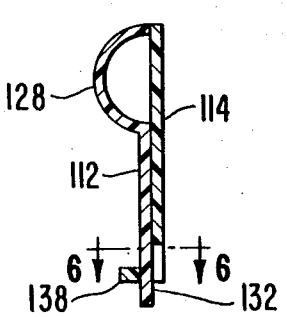
FIG. 7 is a cross-section taken along line 5—5 of FIG. 3.
Figure 9:
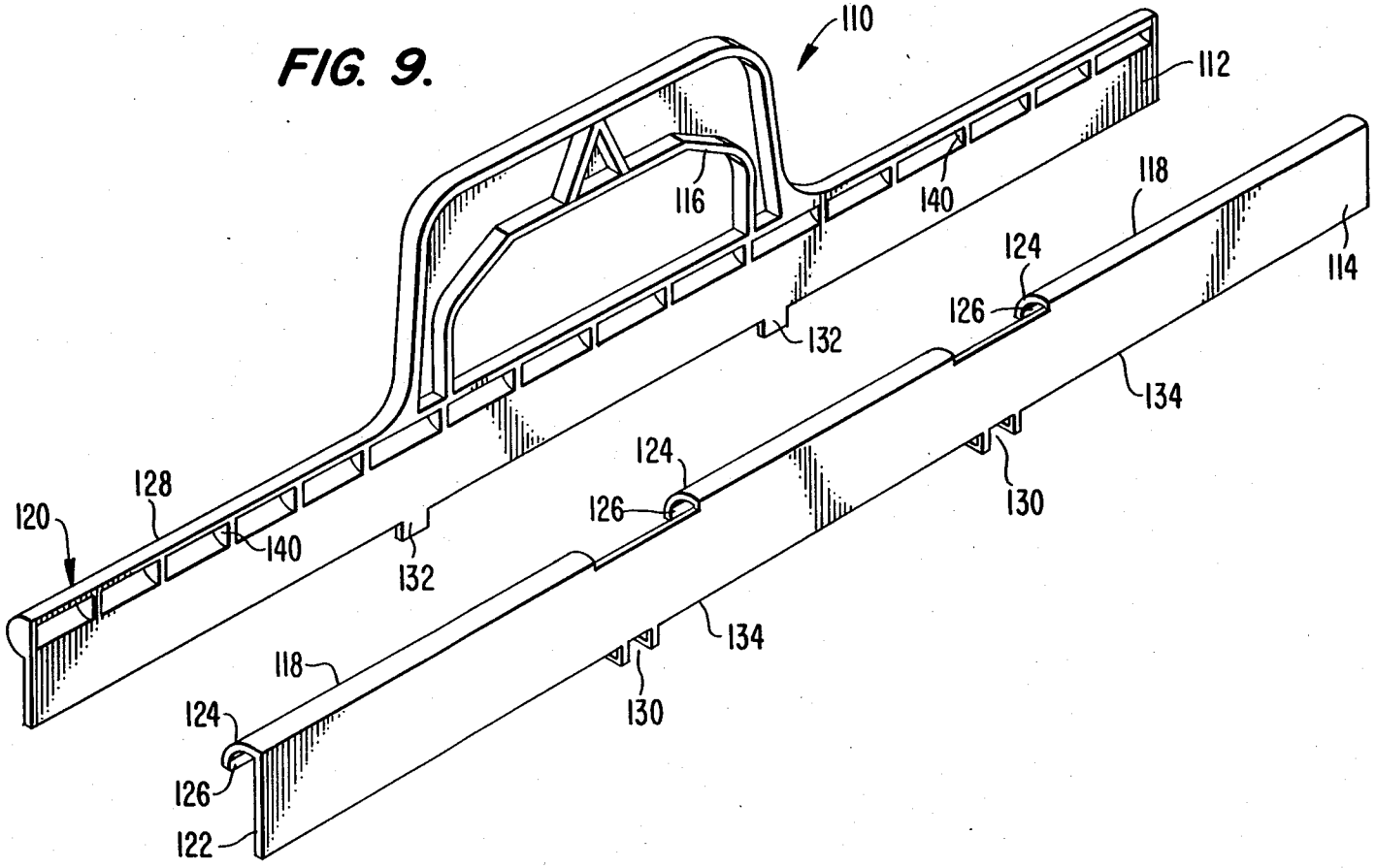
FIG. 9 is a perspective view showing the carrier bag handle closure of FIG. 3 in an open position.

As shown in FIGS. 3 and 9, the curved wall 124 extends along a major portion of the length of the handle strip 114. Likewise, the arcuate surface 128 on the handle strip 112 extends along a major portion of the length of the handle strip 112. Such an embodiment strengthens the snap-on engagement due to the relatively long length of the handle strips 112 and 114 cver which the weight of the carrier bag is distributed by the snap-on engagement. Ribs 140, as shown in FIG. 9, can also be positioned within the arcuate surface 128 and enhance the snap--on engagement. This snap-on engagement of the inner closure member 118 and the outer closure member 120 is especially shown in FIGS. 5 and 6. In such an embodiment, the arcuate surface 128 is positioned within the groove 126 of the cr:rved wall 124 to provide a complementary snap-on engagement between the arcuate surface 128 and the curved wall 124 defining the groove 126. The snap-on engagement is achieved by snapping the curved wall 124 over the arcuate surface 128. Likewise, the snap-on engagement is relieved by removing the curved wall 124 from the arcuate surface 128 by lifting up a small tab 142 in the center of the curved wall 124.

Figure 8:
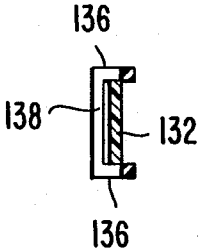
FIG. 8 is a cross-section taken along line 6—6 of FIG. 7.
Figure 6:
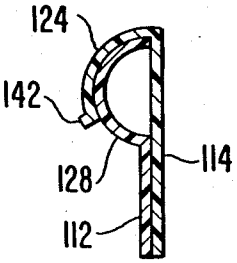
FIG. 6 is a cross-section taken along line 4—4 of FIG. 3.
Figure 5:
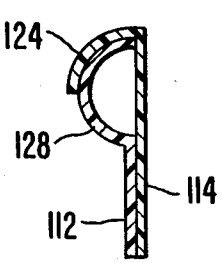
FIG. 5 is a cross-section taken along line 3—3 of FIG. 3.

An interlocking means on the lower portion of each handle strip retains the handle strips together at the lower portion when the handle strips are adjacent to each other. The interlocking means is formed by one or more complementary interlocking slots 130 and tabs 132 on the handle strips 112 and 114 near the bases 134 of the handle strips 112 and 114. Each slot 130 is preferably formed by end sections 136 extending substantially perpendicular to the handle strip 114. A crossbar 138 interconnects the end sections 136 to form an opening or slot 130 on the handle strip 114, as shown in FIGS. 8 and 9.

The opposing handle strip 112 has one or more tabs 132 extending from the base 134 of the handle strip 112. The tabs 132 on the handle strip correspond in number, size and orientation with the slots 130 on the handle strip 114. Consequently, the tabs 132 slide into the slots 130 when the handle strips 112 and 114 are in the closed position.

To close the bag, the tabs 132 on the handle strip 112 are aligned above the slots 130 on the handle strip 114. The tabs 132 are then slid downwardly into the slots 130. After the tabs 132 are fully seated within the slots 130, the curved wall 124 is snapped on to the arcuate surface 128 to form a snap-on engagement of the inner closure member 120 and outer closure member 118. As a result, the carrier bag handle provides a double lock system for the carrier bag, namely the tab and slot engagement and the snap-on engagement.

To reopen the bag, the curved wall 124 is first snapped off of the arcuate surface 128 to release the snap-on engagement of the inner closure member 120 and the outer closure member 118 by lifting up the small tab 142 in the center of the curved wall 124. Then, the handle strips 112 and 114 are moved laterally away from each other so that the tabs 132 are lifted out of the slot 130. Only then is the carrier bag fully opened.

The closure bag handle of the present invention is preferably used in combination with a bag made of relatively thin polyethylene material. However, other bag materials can also be used within the scope of the invention. The bag handle strips 112 and 114 are preferably attached to the carrier bag 111 along lines 144 of each handle strip 112 and 114 by various techniques shown in the art, such as heat welding. It is an important feature of the invention that the interlocking means located adjacent the lower edges of the handle strips are applied below the line of attachment of the bag to the handle strips, i.e., on the side of the attachment line remote to the handle loop.

Figure 10:
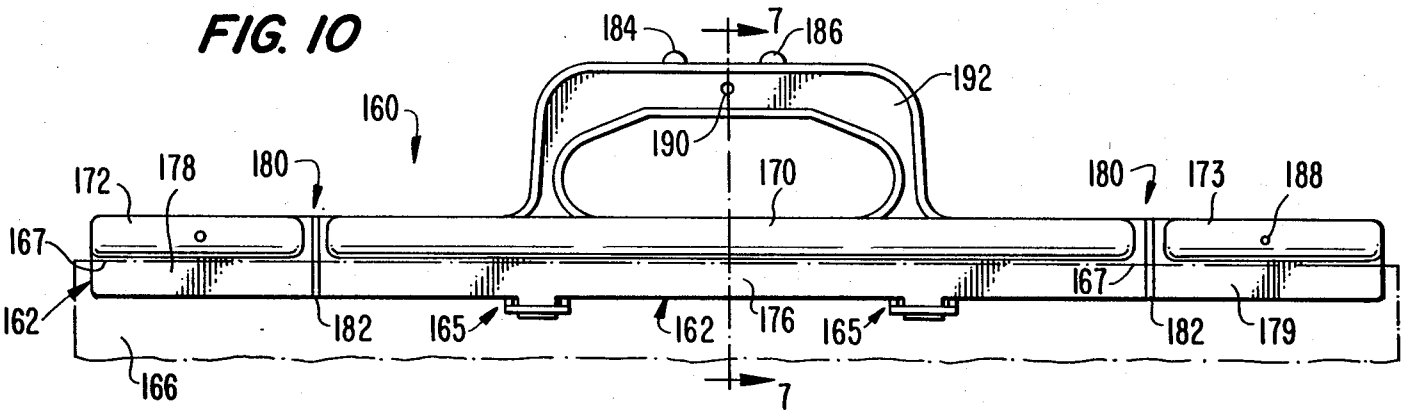
FIG. 10 is a side view of yet another carrier bag handle of the present invention in a closed position.
Figure 11:
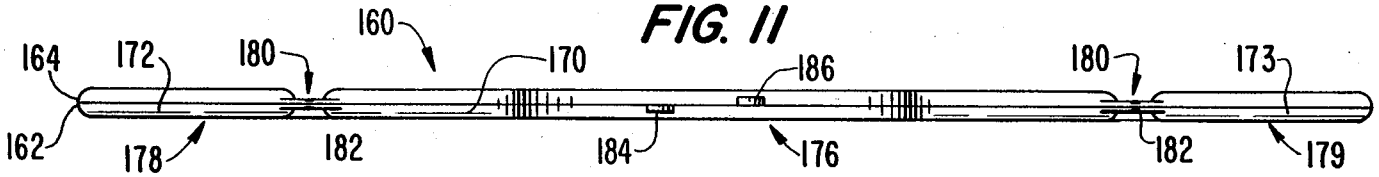
FIG. 11 is a top view of the carrier bag handle shown in FIG. 10.
Figure 12:
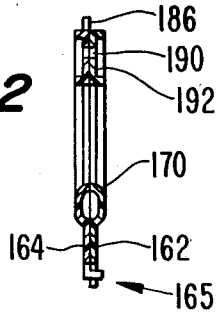
FIG. 12 is a cross-section taken along line 7—7 of FIG. 10.
Figure 13:
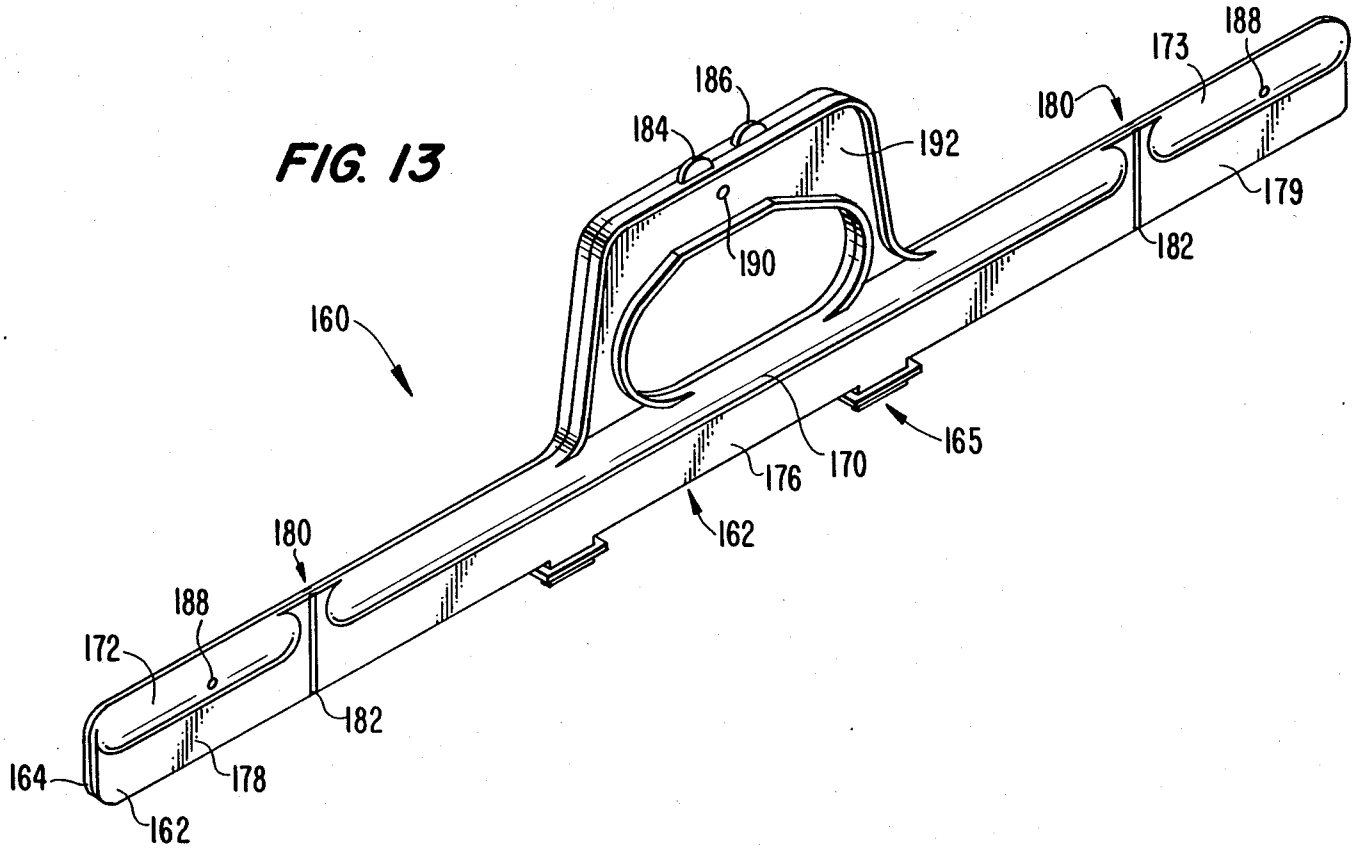
FIG. 13 is a perspective view of the opposite side of the carrier bag handle shown in FIG. 10.

In the embodiment of the invention shown in FIGS. 10, 11, 12 and 13, the carrier bag handle 160 has a pair of symetrical opposing handle strips 162, 164 capable of being attached to a carrier bag 166. Arcuate surfaces walls 170, 172 and 173 are preferably at the upper portion of the handle strips 162, 164 and are curved to form a groove with ribs which are illustrated in more detail in FIG. 9, reference numbers 120, 128 and 140. Arcuate surfaces walls 170, 172 and 173 are provided on the handle strips 162, 164, in part, to enhance the strength of the carrier bag handle 160. The increased strength and rigidity provided by arcuate surfaces 170, 172 and 173 increases the size and load capacity of bags incorporating a carrier bag handle of the present invention. It should be understood that the arcuate surfaces 170, 172 and 173 could be formed in other shapes and still fall within the present invention. Moreover, the arcuate surface could be one continuous element rather than three separate curved walls as illustrated in FIGS. 10, 11 and 13. Providing three separate curved wall elements on each handle strip, however, provides a further modification of applicant's invention as explained in further detail below.

The carrier bag 166 is attached to the handle strips 162, 164 at a line of attachment 167 above interlocking means 165 which are identical to the interlocking means shown in the earlier embodiments. Preferably, when the bag and handle strips are plastic, the bag 166 is attached to handle strips 162, 164 by heat sealing along a line or area which extends the full length of handle strips 162, 164 above interlocking means 165. For instance, the bag may be fastened to the handle strips at line 167 along the length of the handle strips 162, 164 beneath curved walls 170, 172 and 173 and above interlocking means 165.

The handle strips 162, 164 illustrated in FIGS. 10, 11 and 13 are divided into a central segment 176 and two end segments 178, 179. The central segment 176 and the end segments 178 and 179, are separated from the central segment 176 by a hinge 180. In FIGS. 10, 11 and 13 hinge 180 is the space or area between one end of curved wall 170 and curved wall 172, and between the other end of curved wall 170 and curved wall 173. The hinge 180 is further defined in the illustrated embodiment of the present invention by making the material forming the handle strips thinner along line 182 between end segments 178, 179 and central segment 176, than the material forming the remainder of the handle strips 162, 164. Hinge 180 may, of course, be provided in a number of ways besides that illustrated in the drawings. For instance, thinning the material making up the handle strips may alone be sufficient to provide hinges for the end segments of the handle strips. Moreover, separate curved walls may be used alone to define hinged handle strips without thinning the material making up the handle strips.

When a bag using the hinged handle embodiment illustrated in FIGS. 10, 11, 12 and 13 is opened, end segments 178 and 179 move at hinge 180 relative to the central segment 176 to form a substantially rectangular opening. In other words, when a bag is opened and the handle strips are spaced apart, the end segments 178, 179 end up substantially perpendicular to central segment 176 when the bag is fully opened. The hinged end segments aid in maintaining the bag in an open position while the bag is being filled.

Additional features of the handle illustrated in FIG. 10, 12 and 13 are tips 184, 186 which are used to separate the handle strips. By pressing tips 184 and 186 in opposite directions, the frictional lock provided by engagement of pins in holes 188 is more easily overcome. Finally, opening 190 through handle loop 192 provides a convenient opening by which the handle or a bag incorporating the disclosed handle may be suspended. Opening 190, however, may be in any suitable shape such as a triangle or oval.

There will be apparent to those skilled in the art that various modifications and variations could be made in the present invention without departing from the scope and content of the invention. For example, it may be mentioned that in the embodiment of FIGS. 3 to 9 the handle strips 114 could be provided with the interlocking tabs 132, and the other handle strips 112 formed with the slots for receiving the tabs.

What is claimed is:

1. A bag handle comprising:

(a) opposing handle strips each having a line of attachment for a bag; and (b) releasable interlocking means on said handle strips below said line of attachment for said bag, said releasable interlocking means comprising end sections and a crossbar extending from one of said handle strips to form a slot, and a tab forming element extending from a lower portion of the opposing handle strip, wherein said tab forming element is insertable in said slot for securing said strips together.

2. A bag handle as recited in claim 1 further comprising a releasable gripping means disposed above a lower portion of said strips to releasably hold said handle strips together.

3. A bag handle as recited in claim 2 wherein said releasable gripping means comprises a pin in one of said handle strips which frictionally engages a hole in the opposite handle strip when said handle strips are brought together.

4. A bag handle as recited in claim 1 wherein said handle strips include a hinge perpendicular to the length of the strips.

5. A bag handle as recited in claim 4 wherein said handle strips include an arcuate surface for increasing the strength of said handle strips.

6. A bag handle as recited in claim 5 wherein said handle strips include a plurality of arcuate surfaces which divide said handle strip into a at least one central segment and two end segments.

7. A bag handle as recited in claim 6 wherein a hinge is located between each of said two end segments.

8. A bag handle as recited in claim 1 wherein said handle strips include an arcuate surface for increasing the strength of said handle strips.

9. A bag handle as defined in claim 1 having a pair of opposing handle strips capable of being attached to a carrier bag, at least one of said handle strips having a handle loop, wherein one of said opposing handle strips has an outer closure member and the other opposing handle strip has an inner closure member, said outer closure member and the inner closure member coacting in a complementary snap-on engagement when said carrier bag is in a closed position.

10. A bag handle as recited in claim 9, wherein the interlocking means comprises one or more complementary interlocking slots and tab forming elements.

11. A bag handle as recited in claim 9, wherein the outer closure member and the inner closure member are positioned on an upper portion of the handle strips.

12. A bag handle as recited in claim 9, wherein the outer closure member is a curved wall that defines a groove between the curved wall and the upper portion of the handle strip having the outer closure member.

13. A bag handle as recited in claim 12, wherein the inner member is an arcuate surface on the handle strip that fits within the groove when the carrier bag handle is in a closed position.

14. A bag handle as recited in claim 13, wherein the curved wall extends along a major portion of the length of one of the handle strips and wherein the arcuate surface on the opposing handle strips extends along a major portion of the length of the handle strips.

15. A bag handle as recited in claim 1 having a pair of opposing handle strips capable of being attached to a bag, at least one of the handle strips having a handle loop, wherein one of the opposing handle strips has a curved wall that defines a groove between the curved wall and the upper portion of the handle strip, the other opposing handle strip having an arcuate surface on the handle strip that fits within the groove when the carrier bag handle is in the closed position, the curved wall and the arcuate surface coacting in a complementary snap-on engagement.

16. A carrier bag handle as recited in claim 15 wherein the curved wall extends along a major portion of the length of one of the handle strips, and wherein the arcuate surface on the opposing handle strips also extends along a major portion of the length or the handle strips.

17. A bag handle closure device, comprising:

(a) a pair of opposing handle strips adapted to be attached to a bag along a line of attachment for said bag, at least one of said handle strips having a handle loop;

(b) interlocking means on said handle strips below said line of attachment for said bag, wherein said interlocking means includes end sections and a crossbar extending from a lower portion of one of said handle strips to form a notch, and a tab forming element extending from a lower portion of the other one of said handle strips wherein said tab forming element is insertable in said notch for retaining said handle strips together when they are adjacent to each other; and (c) releasable gripping means at an area above said interlocking means to releasably hold said handle strips together, thereby inhibiting an inadvertent opening of the handle strips while permitting a quick opening thereof when desired.

18. A device as recited in claim 17, wherein both of said handle strips have a handle loop, both of said handle loops being adapted to be aligned with each other.

19. A device as recited in claim 17, wherein at least one of said handle strips is an elongate strip.

20. A device as recited in claim 17, wherein said slot is adapted to receive said tab to allow an interlocking thereof prior to gripping engagement of the releasable gripping means.

* * * * *